US012305358B2

(12) United States Patent
Meschke et al.

(10) Patent No.: US 12,305,358 B2
(45) Date of Patent: May 20, 2025

(54) PNEUMATIC EXCAVATOR AND METHODS OF USE

(71) Applicant: Sonny's HFI Holdings, LLC, Wilmington, DE (US)

(72) Inventors: Timothy Meschke, Carver, MN (US); Ian Taylor, Inver Grove Heights, MN (US); Nathan Schlueter, Bloomington, MN (US)

(73) Assignee: Sonny's HFI Holdings, LLC, Wilmington, DE (US)

( * ) Notice: Subject to any disclaimer, the term of this patent is extended or adjusted under 35 U.S.C. 154(b) by 0 days.

(21) Appl. No.: 18/416,082

(22) Filed: Jan. 18, 2024

(65) Prior Publication Data

US 2024/0254724 A1 Aug. 1, 2024

Related U.S. Application Data

(60) Provisional application No. 63/441,961, filed on Jan. 30, 2023.

(51) Int. Cl.

| | |
|---|---|
| ***E02F 3/88*** | (2006.01) |
| ***E02F 3/92*** | (2006.01) |
| *E02F 3/90* | (2006.01) |

(52) U.S. Cl.

CPC ..... *E02F 3/8891* (2013.01); *E02F 3/9206* (2013.01); *E02F 3/907* (2013.01)

(58) Field of Classification Search

CPC ..... E02F 3/9206; E02F 3/8891; E02F 3/925; E02F 5/003; E02F 9/2267; E02F 3/907

See application file for complete search history.

(56) References Cited

U.S. PATENT DOCUMENTS 521,883 A 6/1894 Holland
3,125,819 A 3/1964 Kaufmann
(Continued)

FOREIGN PATENT DOCUMENTS

EP 0251660 A1 * 1/1988
EP 0566543 A1 * 10/1993
(Continued)

OTHER PUBLICATIONS

Invitation to Pay Additional Fees dated Apr. 26, 2024 in connection with International Patent Application No. PCT/US2024/013280, 4 pages, Apr. 26, 2024.
(Continued)

*Primary Examiner* — Adam J Behrens
*Assistant Examiner* — Blake E Scoville
(74) *Attorney, Agent, or Firm* — Dorsey & Whitney LLP

(57) ABSTRACT

A pneumatic excavator configured to be pneumatically actuated includes an actuator; a flow valve fluidly coupled to the actuator an air actuation conduit; and a barrel coupled to an egress of the flow valve, where the barrel defines an outlet of the pneumatic excavator. Actuating the actuator causes compressed air to be transmitted from the actuator through the an air actuation conduit to a first port of the flow valve to open the flow valve and compressed air from a supply of compressed air passes through the flow valve and the outlet of the pneumatic excavator. Releasing the actuator causes the compressed air to be transmitted from the actuator through the at least one air actuation conduit to a second port of the flow valve to cause the flow valve to close and the flow valve prevents the compressed air from the supply of compressed air from passing therethrough.

20 Claims, 10 Drawing Sheets

(56) References Cited

U.S. PATENT DOCUMENTS 3,670,514 A 6/1972 Breston et al.
3,881,530 A 5/1975 Faldi
4,114,723 A 9/1978 Paitson et al.
4,176,487 A 12/1979 Manis
4,253,255 A 3/1981 Durell
4,331,140 A 5/1982 Hallsey
4,377,168 A 3/1983 Rzasa et al.
4,412,656 A * 11/1983 Beck ..... A01M 7/0046 239/281
4,936,031 A 6/1990 Briggs et al.
4,991,321 A 2/1991 Artzberger
5,016,717 A 5/1991 Simons et al.
5,140,759 A 8/1992 Artzberger
5,170,943 A * 12/1992 Artzberger ..... E02F 3/9206 239/290
5,186,392 A * 2/1993 Pleshek ..... B08B 3/028 401/289
5,212,891 A 5/1993 Schuermann et al.
5,220,935 A 6/1993 Bailey et al.
5,244,364 A 9/1993 Laco et al.
5,263,504 A 11/1993 Bailey et al.
5,487,229 A 1/1996 Nathenson et al.
5,782,414 A 7/1998 Nathenson
5,785,067 A 7/1998 Kosofsky
5,803,982 A 9/1998 Kosofsky et al.
5,806,616 A 9/1998 Enlund et al.
5,832,974 A 11/1998 Jou
5,860,232 A 1/1999 Nathenson et al.
5,966,847 A * 10/1999 Nathenson ..... E02F 3/9206 137/874
5,976,268 A 11/1999 Eliason et al.
5,993,117 A 11/1999 Lancaster et al.
5,996,847 A 12/1999 Smolen et al.
D435,207 S 12/2000 Nathenson et al.
6,158,152 A 12/2000 Nathenson et al.
6,202,330 B1 3/2001 Bolton
6,283,340 B1 * 9/2001 Waldner ..... B05B 1/005 222/530
6,397,878 B1 6/2002 Nolan
6,470,605 B1 10/2002 Gilman et al.
6,615,849 B1 9/2003 Gilman et al.
6,618,966 B2 9/2003 Russo et al.
7,475,831 B2 1/2009 Van et al.
7,631,444 B1 12/2009 Hursen
7,676,965 B1 3/2010 Nathenson et al.
7,677,476 B2 * 3/2010 Burdsall ..... B08B 3/026 239/525
9,056,328 B2 6/2015 Giovannini
9,382,688 B2 * 7/2016 Buckner ..... E02F 9/2217
9,475,174 B2 10/2016 Hursen
9,855,573 B2 1/2018 Hursen
D865,120 S 10/2019 Tibell et al.
10,603,780 B2 3/2020 Hursen
10,792,681 B2 10/2020 Alves
10,920,397 B2 2/2021 Buchleiter et al.
11,278,940 B2 3/2022 Takada et al.
2006/0065309 A1 3/2006 Leasure et al.
2008/0040945 A1 2/2008 Buckner
2009/0255272 A1 10/2009 Tibell
2009/0284068 A1 11/2009 Yu et al.
2010/0095559 A1 4/2010 Buckner
2010/0196129 A1 8/2010 Buckner
2011/0296646 A1 12/2011 Showley
2012/0007009 A1 1/2012 Yie
2013/0185966 A1 7/2013 Harrington
2013/0189060 A1 7/2013 Lamonte
2013/0340297 A1 12/2013 Buckner
2014/0020268 A1 1/2014 Buckner
2014/0130382 A1 * 5/2014 Harrington ..... E02F 3/966 37/195
2014/0231326 A1 8/2014 Biley et al.
2015/0176243 A1 6/2015 Buckner
2016/0207057 A1 7/2016 Hursen
2020/0070180 A1 3/2020 Tibell
2023/0080378 A1 3/2023 Richter et al.
2024/0254723 A1 8/2024 Meschke et al.
2024/0254725 A1 8/2024 Meschke et al.
2024/0254726 A1 8/2024 Meschke et al.

FOREIGN PATENT DOCUMENTS

EP 1803980 A1 7/2007
WO 2017217916 A1 12/2017
WO 2024163314 A2 8/2024

OTHER PUBLICATIONS

International Search Report and Written Opinion dated Jul. 10, 2024 in connection with International Patent Application No. PCT/US2024/013280, 17 pages, Jul. 10, 2024.

* cited by examiner

PNEUMATIC EXCAVATOR AND METHODS OF USE

CROSS-REFERENCE TO RELATED APPLICATIONS

This application claims the benefit of U.S. Provisional Patent Application No. 63/441,961, filed Jan. 30, 2023, entitled "PNEUMATIC EXCAVATOR AND METHODS OF USE", which relates to commonly owned U.S. Provisional Patent Application No. 63/441,954, filed Jan. 30, 2023, entitled "PNEUMATIC EXCAVATOR AND METHODS OF USE", U.S. Provisional Patent Application No. 63/441,957, filed Jan. 30, 2023, entitled "PNEUMATIC EXCAVATOR AND METHODS OF USE", and U.S. Provisional Patent Application No. 63/441,966, filed Jan. 30, 2023, entitled "PNEUMATIC EXCAVATOR AND METHODS OF USE", each of which are herein incorporated by reference in their entireties for any useful purpose.

TECHNICAL FIELD

Implementations are directed to excavators, and more particularly to hand-held pneumatic excavators and methods of use.

BACKGROUND

Compressed air excavators cause compressed air to exit from a nozzle disposed at an end of an open pipe, which may be useful in operations such as loosening soil from buried pipes, gas mains, cables and cleaning. In prior approaches, pressurized water directed at the soil resulted in the generation of hazardous waste by the water mixing with contaminants in the soil that requires special treatment prior to disposal. In other approaches, mechanical digging implements such as blades and picks having hard cutting edges often damage the objects to be excavated or cleaned. The use of compressed air has the advantage of avoiding generation of hazardous waste while loosening soil without causing damage to the object targeted.

SUMMARY

Pneumatic excavators and methods of use are thus provided. According to implementations, a pneumatic excavator configured to be pneumatically actuated may include an actuator; a flow valve fluidly coupled to the actuator by at least one air actuation conduit; and a barrel coupled to an egress of the flow valve, wherein an egress of the barrel defines an outlet of the pneumatic excavator. A primary flow passage is defined at least by the flow valve and the barrel. Actuating the actuator may cause compressed air to be transmitted from the actuator through the at least one air actuation conduit to a first port of the flow valve to cause the flow valve to move to an open position such that compressed air from a supply of compressed air passes through the primary flow passage and exits through the outlet of the pneumatic excavator. Releasing the actuator causes the compressed air to be transmitted from the actuator through the at least one air actuation conduit to a second port of the flow valve to cause the flow valve to move to a closed position. In in the closed position, the flow valve prevents the compressed air from the supply of compressed air from passing therethrough.

In various implementations and alternatives, the air actuation conduit may further include a first air actuation conduit and a second air actuation conduit, the first air actuation conduit may extend between a first port of the actuator and the first port of the flow valve, the second air actuation conduit may extend between a second port of the actuator and the second port of the flow valve.

In various implementations and alternatives, the at least one air actuation conduit may include a constant pressure conduit, where a first end of the constant pressure conduit is coupled to the pneumatic excavator at an upstream position from an egress of the flow valve, and a second end of the constant pressure conduit is coupled to the actuator. In such implementations and alternatives, the air actuation conduit may further include the first and second air actuation conduits extending between the actuator and flow valve as provided. In such implementations and alternatives, the actuator may further include a valve. When the actuator is actuated, the valve may be configured to fluidly couple the constant pressure conduit to the first air actuation conduit, and when the actuator is not actuated or is released, the valve may be configured to fluidly couple the constant pressure conduit to the second air actuation conduit. In such implementations and alternatives, the valve may include a trigger biased by a biasing mechanism configured to be manually actuated.

In various implementations and alternatives, in the closed position of the flow valve, a piston of the flow valve may seal against a valve seat. In addition or alternatively, at least one vent port may be provided and configured to vent the compressed air from the flow valve. For instance, the vent port may be defined in the actuator.

In various implementations and alternatives, the actuator may include a trigger biased by a biasing mechanism. For instance, the biasing mechanism may include a return spring.

In various implementations and alternatives, the flow valve may be free of a biasing mechanism such that the flow valve requires the compressed air to move the flow valve to the open position and to the closed position.

According to other implementations, a method of pneumatically actuating a pneumatic excavator may involve supplying compressed air to a pneumatic excavator from a compressed air supply. The pneumatic excavator may include an elongated barrel, an actuator and a flow valve, the elongated barrel having an ingress and an egress, said ingress configured to be fluidly connected to the supply of compressed air, said egress defining an outlet of the pneumatic excavator, the actuator comprising at least one air actuation conduit and configured to be fluidly connected to the supply of compressed air, the flow valve fluidly coupled to the actuator via the at least one air actuation conduit, wherein a primary flow passage is defined at least by the flow valve and the barrel. The method may proceed by actuating the actuator to cause compressed air to be transmitted from the actuator through the at least one air actuation conduit to the flow valve to cause the flow valve to move to an open position, wherein in the open position of the flow valve, the compressed air from the compressed air supply passes through the primary flow passage and exits through the outlet of the pneumatic excavator. The actuator may be released to cause the compressed air to be transmitted from the actuator through the at least one air actuation conduit to the flow valve to cause the flow valve to move to a closed position, wherein in the closed position, the flow valve prevents the compressed air from passing therethrough.

In various implementations and alternatives, the wherein the air actuation conduit further comprises a first air actuation conduit and a second air actuation conduit. When the actuator is actuated, the compressed air may be transmitted through the first air actuation conduit to the flow valve, and wherein when the actuator is released, the compressed air may be transmitted through the second air actuation conduit to the flow valve.

In various implementations and alternatives, the at least one air actuation conduit may include a constant pressure conduit, and the compressed air may be constantly delivered to the constant pressure conduit and to the actuator during the supplying of compressed air. In such implementations and alternatives, the air actuation conduit may further include a first air actuation conduit and a second air actuation conduit, and when the actuator is actuated, the compressed air may be transmitted through the first air actuation conduit to the flow valve, and when the actuator is released, the compressed air may be transmitted through the second air actuation conduit to the flow valve. In such implementations and alternatives, the actuator may further include a valve. When the actuator is actuated, the valve may be configured cause the compressed air to be transmitted through the constant pressure conduit to the first air actuation conduit, and when the actuator is not actuated or is released, the valve may be configured to cause the compressed air to be transmitted through the constant pressure conduit to the second air actuation conduit.

Various implementations and alternatives may further involve venting compressed air from the flow valve when the flow valve is in at least one of the open position or the closed position. In such implementations and alternatives, the actuator may be biased by a biasing mechanism such that the releasing of the actuator causes the actuator to move to an unbiased position.

In various implementations and alternatives, the flow valve may be free of a biasing mechanism such that the flow valve requires the compressed air to move the flow valve to the open position and to the closed position.

DETAILED DESCRIPTION

Figure 1:
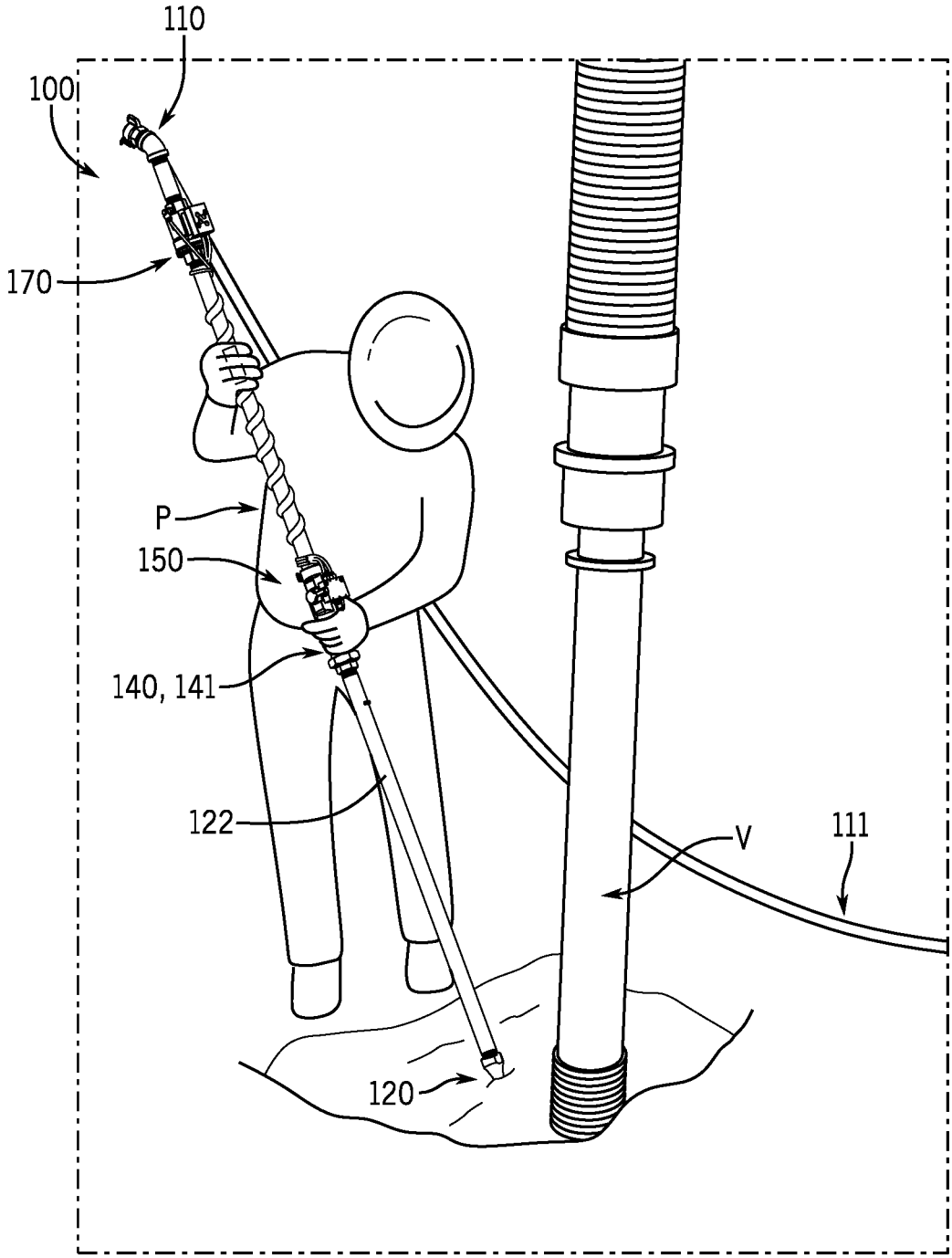
FIG. 1 illustrates a pneumatic air excavator in use in an excavating operation, according to implementations of the present disclosure.

Turning to the Figures, FIG. 1 illustrates a pneumatic air excavator 100 of the present disclosure in an exemplary soil excavating operation. A proximal end 110 of the pneumatic air excavator 100 is removably coupled to an air supply via an elongated delivery line 111. The air supply may be compressed or pressurized air, which may be provided by an air compressor such as an air compressor truck. The air supply may be air (e.g., a mixture of oxygen and nitrogen), a gas or a mixture. A distal end 120 of the pneumatic air excavator 100 may include an extension 122 and a nozzle 130 (see, e.g., FIG. 2A) configured to deliver the compressed air, for instance, to break apart soil covering a buried target object, e.g., a pipe, cable, or other structure(s). A barrel 140 extending between the proximal and distal end 110, 120 of the pneumatic air excavator 100 may be held by a user P during use. The barrel 140 may include an actuator assembly 150 movably coupled to an exterior 141 of the barrel 140 by a releasable coupling 160 (see, e.g., FIG. 2A). The actuator assembly 150 may be held by one hand of the user P for controlling an on/off status of the pneumatic air excavator 100, while a different region of the pneumatic air excavator 100 may be held by the other hand of the user P, such as at a primary valve or flow valve 170. As the soil is loosened during operation of the pneumatic air excavator 100, an industrial vacuum V may extract the loosened soil and may for instance deposit the soil in a location for future use or removal.

Figure 2A:
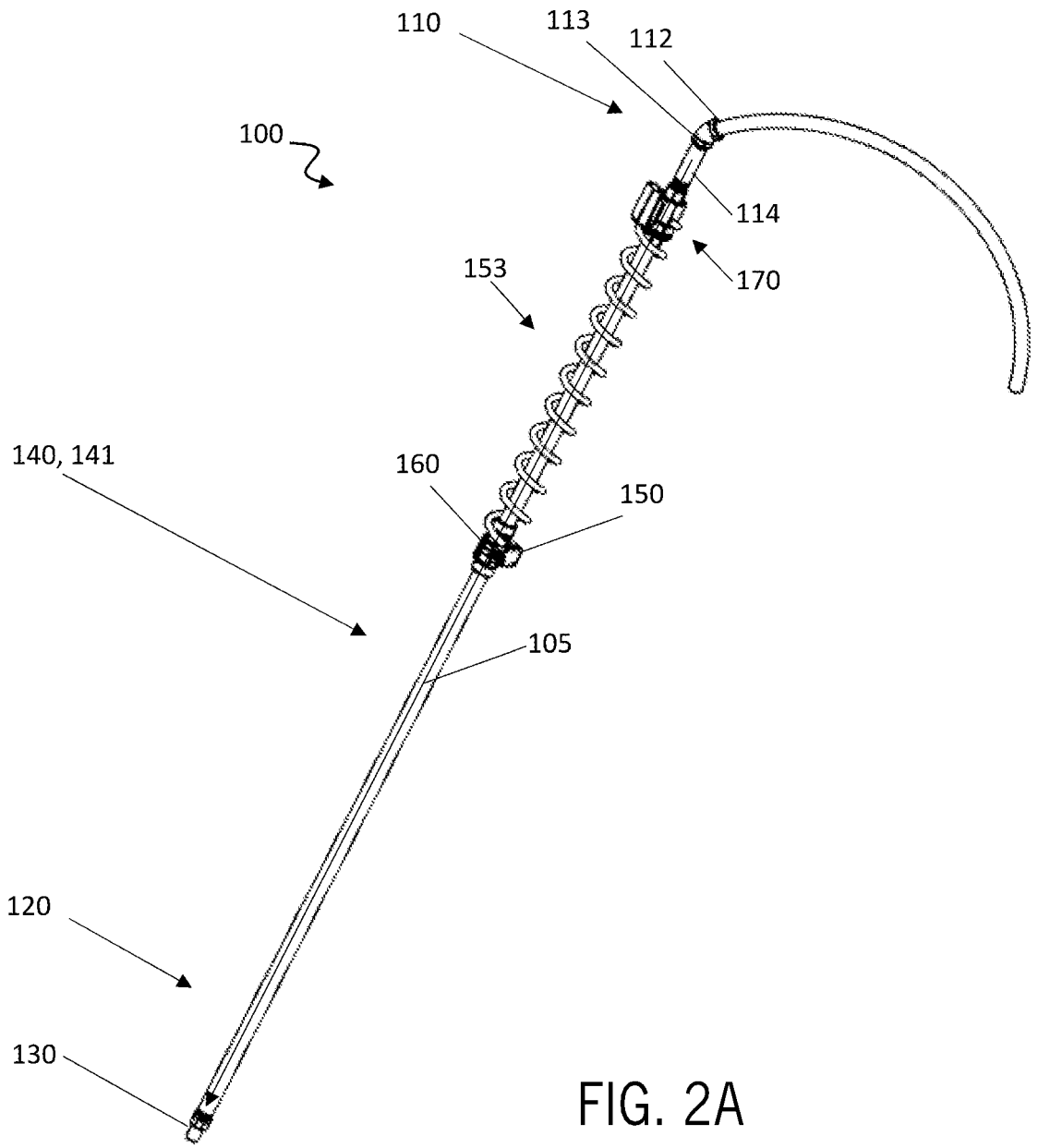
FIGS. 2A, 2B and 2C illustrate a first isometric view, an exploded isometric view, and a second isometric view, respectively, of the pneumatic air excavator, according to implementations of the present disclosure.
Figure 2B:
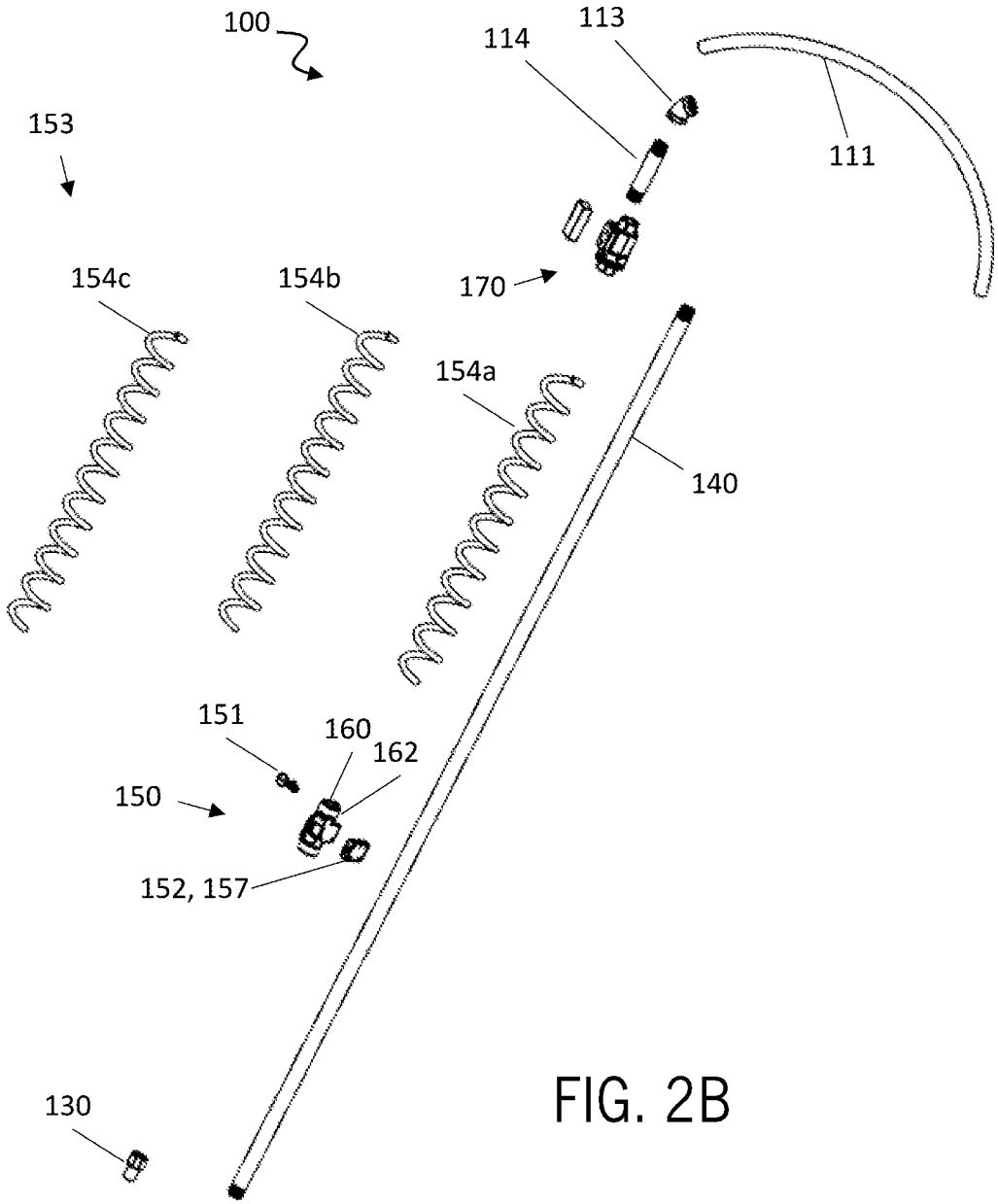

FIGS. 2A and 2B illustrate an isometric view and an exploded isometric view, respectively, of the pneumatic air excavator 100 of the present disclosure. As shown in FIG. 2A, components of the pneumatic air excavator 100 may be coaxially arranged such as the nozzle 130, barrel 140, portions of the actuator assembly 150, the releasable coupling 160, and the primary flow valve 170. A primary flow passage 105 of the pneumatic air excavator 100 may extend along a central axis thereof and may be defined at least by the flow valve 170, the barrel 140 and nozzle 130.

Figure 2C:
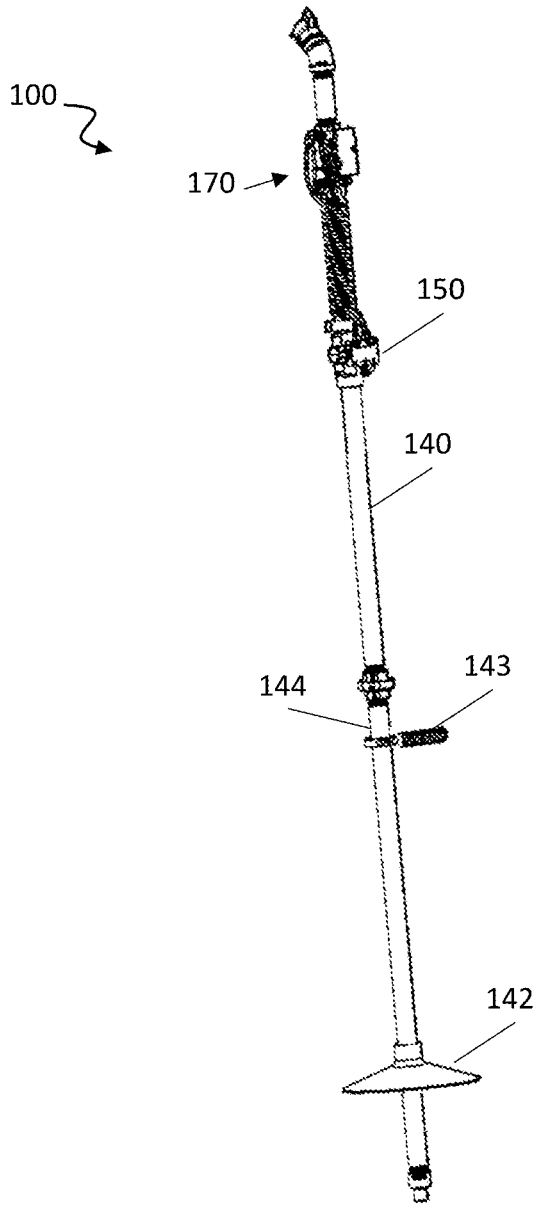
Figure 2D:
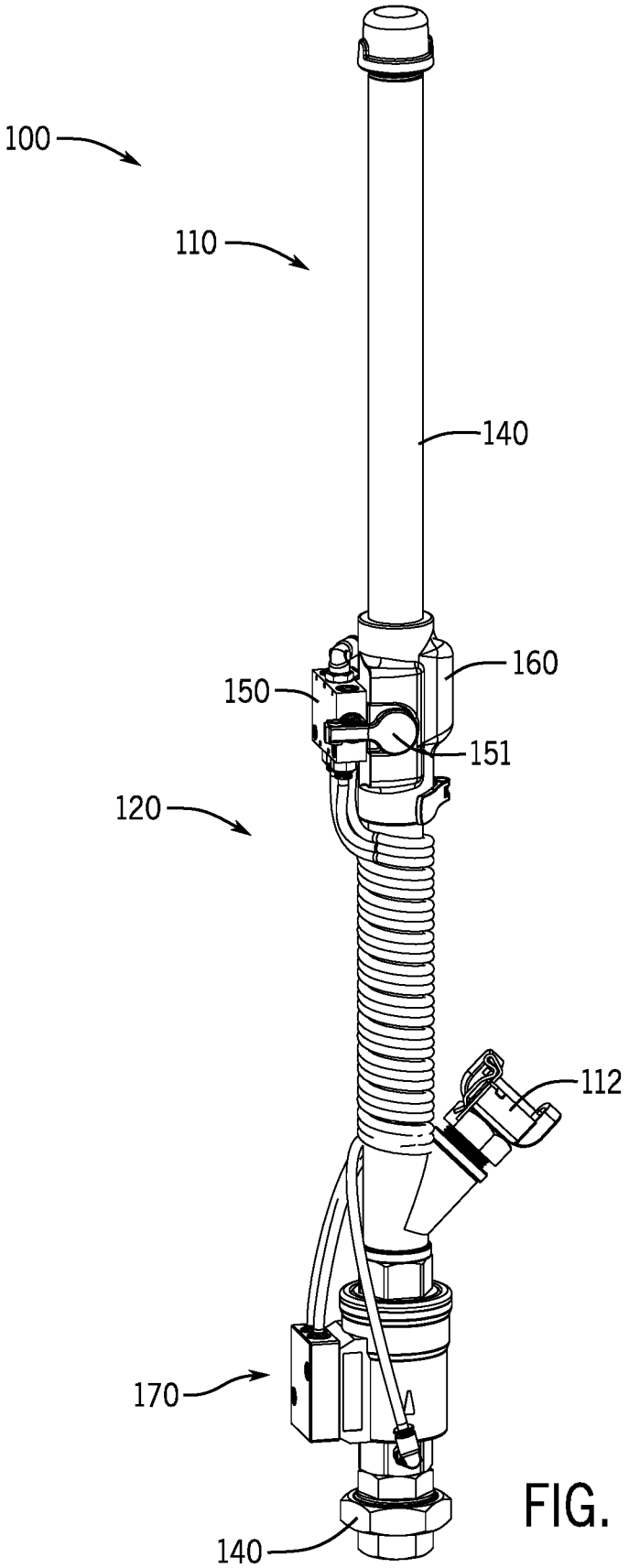
FIG. 2D shows the pneumatic air excavator with an alternative fitting position, according to implementations of the present disclosure.

At the proximal end 110 of the air excavator 100, a port or fitting 112 may be provided for removably connecting to the air supply via the delivery line 111 to establish a fluid coupling to the air supply. For instance the delivery line 111 may include a fitting that is complementary to the fitting 112, or the two may otherwise be configured for coupling to one another directly or indirectly to provide an air tight connection. For instance, the fitting 112 may be a quick connect fitting, a claw connector such as a Chicago claw connector, or other air supply connection. The proximal end 110 may optionally include an angled conduit or pipe 113 and/or a straight conduit or pipe 114, each of which may for instance facilitate ergonomics of using the pneumatic air excavator 100 when coupled to the delivery line 111. Alternatively, the port or fitting 112 may be positioned at a distal end 120 of the air excavator 100, as shown in FIG. 2D, and for instance may be arranged distal to the actuator assembly 150 and the releasable coupling 160. In such case, the barrel 140 extending between the proximal and distal ends 110, 120 may enable the releasable coupling 160 to be moved to various positions along the barrel 140 and locked thereto, and this portion of the barrel 140, in some instances, may not receive airflow from the air supply, and may thereby provide flexibility in the configuration of the releasable coupling 160 and the barrel 140. Arrangement of the port or fitting 112 at the distal end 120 may lower the center of gravity of the pneumatic excavator to a more centralized position, for instance to provide better ergonomics and reduce fatigue. In such examples, the barrel 140 may be arranged both at the inlet end 179 of the flow valve 170 and the outlet end 178 of the flow valve 170 as shown in FIG. 2D.

The distal end 120 of the pneumatic air excavator 100 may define an outlet and may include a nozzle 130 coupled thereto. For instance, the nozzle 130 may be coupled to an egress of the barrel 140, and the nozzle 130 may define an outlet for the pneumatic excavator 100. The nozzle 130 may have various configurations depending on the desired delivery pressure and flow geometry emitted therefrom. For instance, the nozzle 130 may have a supersonic nozzle design. The nozzle 130 may be constructed of various materials such as metal including brass, stainless steel, composites such as polymers, reinforced polymers, a combined construction of metallic and polymer materials, and combinations thereof. The type of nozzle may include but is not limited to 30-300 cubic feet per minute (cfm) at 70 to 250 psi. The nozzle 130 may be interchangeable with other nozzles and may be releasably coupled to the distal end 120 such as via a threaded engagement or other fastening mechanism, e.g., quick connect. Alternatively, the nozzle 130 may be non-detachably connected to the distal end 120 of the pneumatic air excavator 100. In addition or alternatively, the nozzle 130 may include a non-conductive cover or coating, e.g., a rubber, polymer, of the like, for protecting the air excavator 100 and user from electrical shocks during excavation operations near power sources.

In some implementations, the distal end 120 of the pneumatic air excavator 100 may be formed of an optional barrel extension 122 as illustrated in FIG. 1. The barrel extension 122 may have the same or a different configuration as the barrel 140 of the pneumatic air excavator 100 and may be detachably coupled to the barrel 140 such as via a threaded collar or via another fastening mechanism such as those disclosed herein. The barrel extension 122 may enable the user P to use the pneumatic air excavator 100 in excavation applications at varying depths, and for instance, a longer extension 122 may be joined to the barrel 140 when the target object has a depth that is deeper than the length of the barrel 140. This may enable the user P to operate the pneumatic air excavator 100 more comfortably, as the user may operate the system in a standing position instead of a kneeling or bent position. In some implementations, the extension 122 and the barrel 140 may be telescopically arranged, and the length of the pneumatic air excavator 100 may be adjustable, such as by operating an adjustment collar that permits telescopic movement of the extension 122 relative to the barrel 140. The extension 122 may be constructed of the same or different material from the barrel 140, and for instance may be constructed of a non-conductive material such as fiberglass, plastics, rubbers, polymers, lined or coated material, aluminum, and so on.

The barrel 140 may define a portion of the primary flow passage 105 of the pneumatic air excavator 100 for delivering compressed air to the nozzle 130. The barrel 140 may be configured as a rigid, elongated tubular conduit having an ingress and an egress, and the ends may be coupled to various components as described herein, e.g., the ingress may be coupled to the delivery line 111 and the egress may be coupled to the nozzle 130 in a detachable or non-detachable manner. The barrel 140 may be constructed of a non-conductive material such as fiberglass, plastics, rubbers, polymers, lined or coated material, aluminum, and so on. In some implementations, an adjustable shield 142 may be slidably arranged on the barrel 140 proximate the distal end (FIG. 2C). The adjustable shield 142 may be cone-shaped and may deflect debris during an excavation operation.

The actuator assembly 150 of the pneumatic air excavator 100 may be arranged along the barrel 140 as shown in FIGS. 2A, 2C and 2D. The actuator assembly 150 may generally include an actuation switch and may be releasably coupled to the barrel 140 by the releasable coupling 160 described herein. The actuation switch of the actuator assembly 150 may include a trigger 151, e.g., a push button, coupled to a trigger valve 152. The trigger 151 may be biased by a biasing mechanism such as a spring or a solenoid valve. For instance, the trigger valve 152 may include a spool valve with a spool and spool pilot, where the spool is biased by a biasing mechanism such as a spring or solenoid valve, and the trigger 151 may move the spool against the bias force of the biasing mechanism. An actuation conduit 153 may be coupled between the actuator assembly 150 and the flow valve 170, which may be movably adjustable as provided herein.

Operation of the actuation switch may cause the pneumatic air excavator 100 to be turned on and off via the actuation conduit 153. For instance, to activate the actuator assembly 150, the actuation switch may be moved to a closed position, e.g., by depressing the trigger 151. In response, the actuation conduit 153 coupled between the actuator assembly 150 and the flow valve 170 sends a signal to cause the main valve 170 to move to an open position, such that compressed gas from the delivery line 111 is permitted to pass through the main valve 170 as well as the primary flow passage 105 of the pneumatic air excavator 100 such that the compressed air exits through the nozzle 130. The actuator assembly 150 may be deactivated or released by the actuation switch moving to an open position, e.g., by releasing the trigger 151. Where the trigger 151 includes a biasing mechanism, deactivation may cause the trigger 151 to move to a normal position where the biasing mechanism, e.g., a return spring, is relaxed. In response, the actuation conduit 153 may send a signal to cause the flow valve 170 to move to a closed position to prevent the compressed gas from passing through the main valve 170 and thus the primary flow passage 105. The actuation conduit 153 may be a flexible conduit that can be extended and retracted along the barrel 140 of the pneumatic air excavator 100. For instance, the actuation conduit 153 may be configured as flexible air tubing (e.g., an air actuation conduit), as a flexible electrical conduit (e.g., a conductive wire), and may be coiled around the barrel 140, strung along the barrel 140, e.g., between the actuator assembly 150 and the flow valve 170, or may be telescopic along the barrel 140. In some implementations, a sleeve may cover the actuation conduit 153. The actuation conduit 153 may be provided as one or more conduits. For instance, one, two, three, four, five six, seven or more conduits may be provided in the actuation conduit.

Although the actuator assembly 150 is illustrated as being positioned on the releasable coupling 160, the actuator assembly 150 may alternatively be positioned on the flow valve 170 or another portion of the pneumatic air excavator 100. In addition or alternatively, although the actuator assembly 150 is illustrated as being positioned distal to the flow valve 170, the actuator assembly and, in some cases, the releasable coupling 160 carrying the actuator assembly 150, may alternatively be positioned proximal to the flow valve 170 of the pneumatic air excavator 100.

The releasable coupling 160 may be configured to releasably couple the actuator assembly 150 to the barrel 140 in a plurality of locked positions along a length of the barrel 140 when in a released position, and may be locked or fixed to the exterior 141 of the barrel 140 in the locked position. The releasable coupling 160 may include a sleeve-shaped portion 161 (FIG. 3) surrounding the barrel 140, which may be locked and unlocked by a locking mechanism 162 such as a clamp or a cam lock, e.g., clamping handle coupled to a split ring or clamp, for establishing a pinch, compression, and/or friction lock. The locking mechanism 162 may engage with the barrel 140 via a pinch or clamping mechanism along the external diameter of the barrel 140. In an unlocked position of the locking mechanism 162, the releasable coupling 160 may be in a released position and be moved or slid along the exterior 141 of the barrel 140, and due to the actuation conduit 153 being adjustable or flexible, movement of the releasable coupling 160 slaves the actuation conduit 153 along the barrel 140 of the pneumatic air excavator 100 (e.g., in an expansion or a retraction movement) and thus the coupling between the actuator assembly 150 and the flow valve 170 via the actuation conduit 153 can be maintained in any position of the actuator assembly 150 relative to the flow valve 170. The locking mechanism 162 of the releasable coupling 160 may be moved to a locked position to secure or lock the releasable coupling 160 to the exterior 141 of the barrel 140.

Figure 5A:
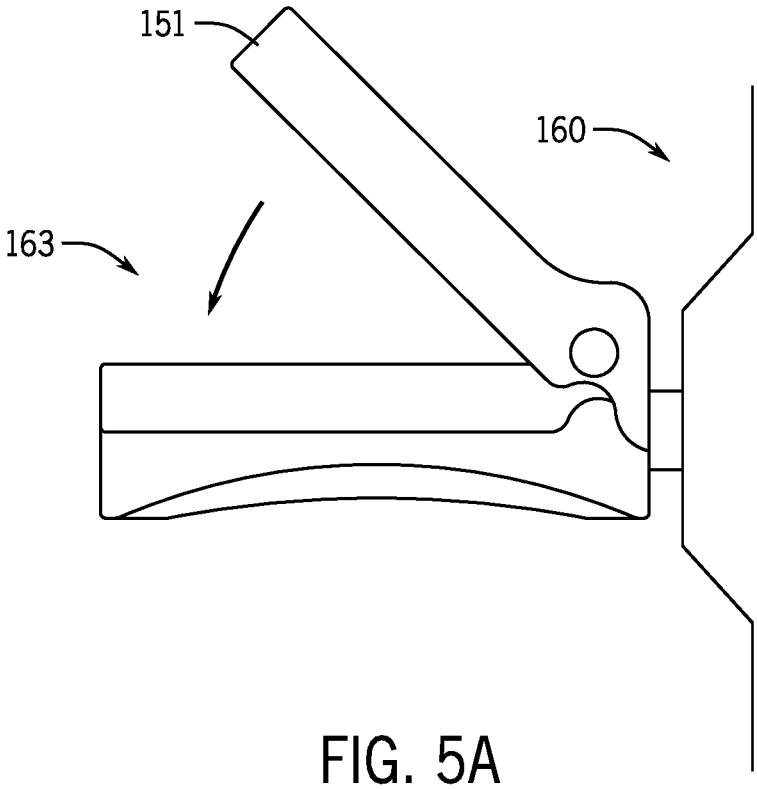
FIGS. 5A and 5B illustrate different positions of a handle of the pneumatic air excavator, according to implementations of the present disclosure.
Figure 5B:
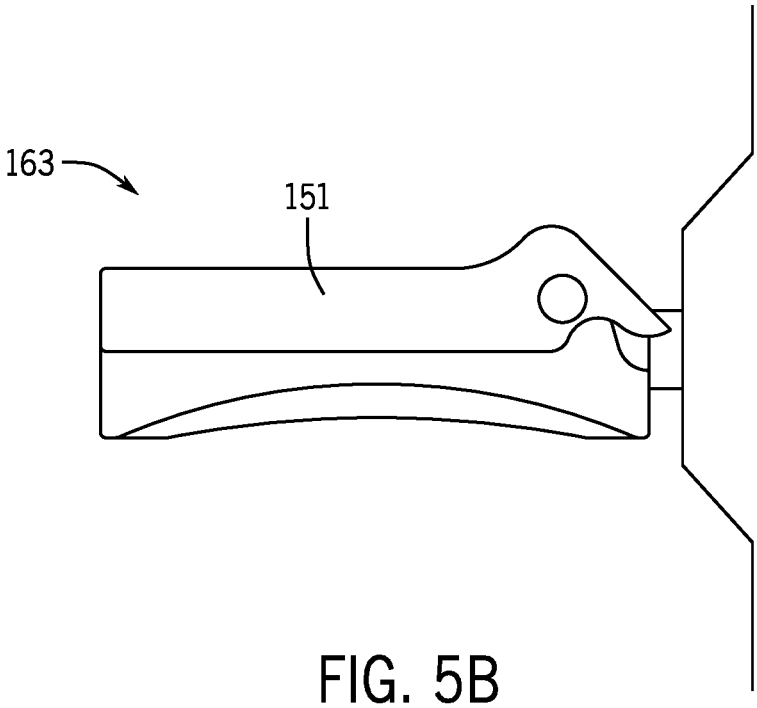

In some implementations, the sleeve-shaped portion 161 of the releasable coupling 160 may include the trigger 151 of the actuator assembly 150 coupled thereto, and for instance the trigger 151 may be arranged on or in the sleeve-shaped portion 161 to provide a user with a grippable portion via the sleeve-shaped portion that can be simultaneously used to actuate the actuator assembly 150 via the trigger 151 between an on and off state. In some implementations, the releasable coupling 160 may additionally include a handle 163 (FIGS. 5A and 5B), which may extend from the sleeve-shaped portion 161 and/or may be integrated with the sleeve-shaped portion 161. As shown in FIGS. 5A and 5B, the trigger 151 of the actuator assembly 150 may be integrated with the handle 163 of the releasable coupling 160 and the trigger 151 may be movable between an off position (FIG. 5A) and an on position (FIG. 5B). In some implementations, the handle 163 may be positioned perpendicularly, at an angle, or parallel relative to the releasable coupling 160 and the barrel 140. In addition, the handle 163 may be an adjustable handle that is adjustable to the aforementioned positions. It will be appreciated that the actuator assembly 150 and releasable coupling 160 may be integrated into an assembly configured to be held or gripped by a single hand of the user P to facilitate ergonomics and use of the pneumatic air excavator 100. In further implementations, a second handle 143 (FIG. 2C) may be releasably coupled to the barrel 140 using a second releasable coupling 144, e.g., a cam lock or clamp, and may be configured to be movable to a plurality of locked positions along the length of the barrel 140 independent from the releasable coupling 160.

Figure 3:
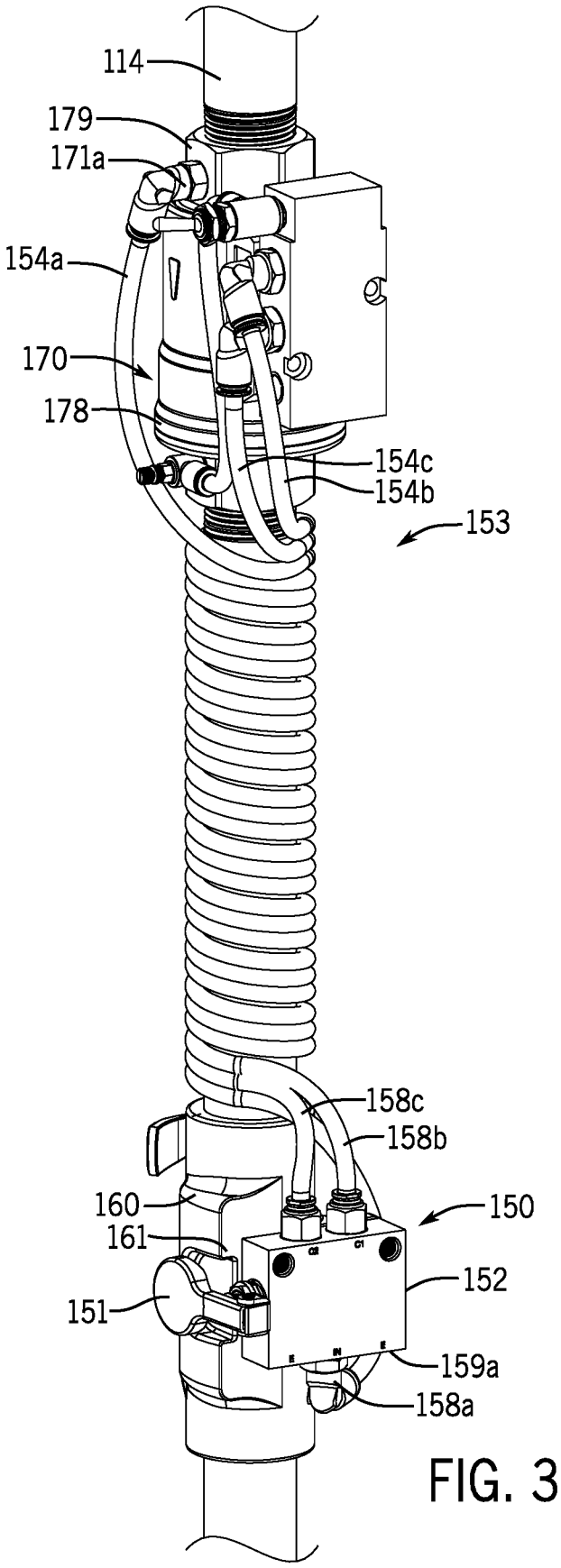
FIG. 3 illustrates a detail view of components of the pneumatic air excavator, according to implementations of the present disclosure.
Figure 4A:
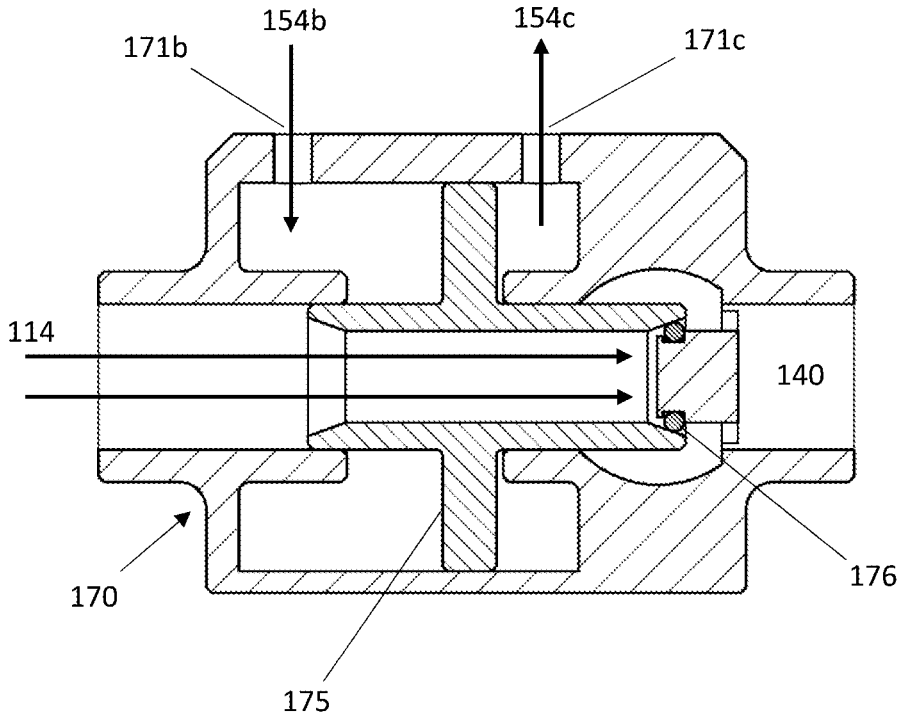
FIGS. 4A and 4B illustrate a valve of the pneumatic air excavator in a closed position and in an open position, respectively, according to implementations of the present disclosure.
Figure 4B:
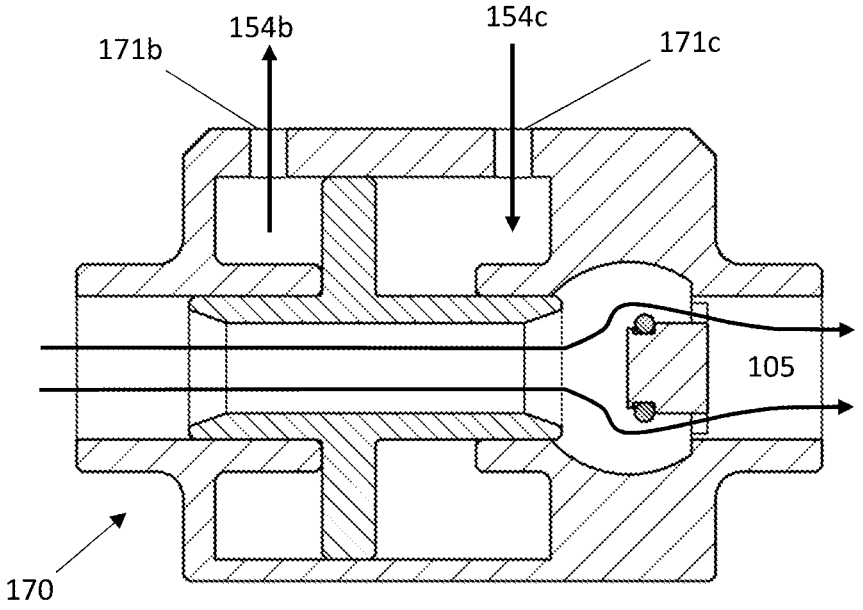

The flow valve 170 also referred to as a primary valve or main valve of the pneumatic excavator 100 may be arranged between the pipe 114 and the barrel 140 as illustrated in FIGS. 4A and 4B and may be responsible for delivering airflow through the pneumatic air excavator when in the actuated or open position. Referring to FIGS. 3, 4A and 4B, the flow valve 170 may include ports 171*a*, 171*b*, 171*c*, a piston 175, a valve seat 176, an outlet end 178 and an inlet end 179, where the portion of the flow valve 170 defining the primary flow passage 105 extends therebetween. In some implementations the flow valve 170 may be free of a return spring, such as where the flow valve 170 is pneumatically operated, while in other implementations, a mechanical biasing mechanism such as a return spring may be included in the flow valve 170. The flow valve 170 may be configured as a pneumatically piloted valve such as a coaxial valve, a double acting coaxial valve, as a solenoid actuated coaxial valve, as a pneumatic actuated angle seat valve or as a pneumatically actuated ball valve.

Ports 171*a*, 171*b*, and 171*c* of the flow valve 170 may be coupled to the actuator assembly 150 via the actuation conduit 153. For instance, referring to FIGS. 2B and 3, the actuation conduit 153 may include at least two flexible air hoses, such as three air hoses 154*a*, 154*b*, and 154*c*. Air hose 154*a* may be configured as a constant pressure conduit, a first end of which may be coupled to the pneumatic air excavator 100 at a port 171*a* upstream from the piston 175 of the flow valve 170, and the air hose 154*a* may extend to and be coupled to the actuator assembly 150, e.g., at port 158*a*, at a second end. Although the port 171*a* is illustrated as being defined in the flow valve 170, it will be understood that the port 171*a* may be defined in other portions of the pneumatic excavator 100 upstream from the flow valve 170. The air hose 154*a* may be constantly supplied compressed air when the delivery line 111 transmits pressurized air. Air hoses 154*b*, 154*c* may each be coupled to respective other ports 171*b*, 171*c* of the main valve 170 and to respective ports 158*b*, 158*c* of the housing 157 of the actuator assembly 150.

In implementations of use, the pneumatic air excavator 100 may be pneumatically turned on and off using the same compressed air supply that is used to operate the pneumatic air excavator 100. For instance, the actuation conduit 153 may include air hoses, e.g., air hoses 154*a*, 154*b*, and 154*c*. The air hoses may receive compressed air from the delivery line 111 or may carry compressed air emitted from the actuator assembly 150 to the flow valve 170. For instance, the compressed air received by the actuator assembly 150 may be derived from the air supply from the delivery line 111, and thus the actuator assembly 150 may receive the same compressed air supply that is used to operate the pneumatic air excavator 100, e.g., when the flow valve 170 is open and the compressed air passes through the primary flow passage 105.

In implementations, actuation of the trigger 151 of the actuator assembly 150 may open a valve of the trigger valve 152, e.g., by movement of a spool against a biasing mechanism such as a return spring, to cause pressurized air from the actuator assembly 150 to enter the actuation conduit 153, e.g., air hose 154*c*, fluidly coupled to the main valve 170, and the actuation conduit 153 may deliver the pressurized air to a port, e.g., port 171*c*, of the main valve 170 to cause the main valve 170 to open and thereby permit pressurized air to flow through primary flow passage 105 of the pneumatic air excavator 100. Release of the trigger 151 may cause the trigger valve 152 to relax, for instance as a biasing force is released such as via relaxation of a spring, which may also cause pressurized air from the air supply to enter the actuation conduit 153, e.g., at air hose 154*b*, and be delivered to the main valve 170, but the pressurized air may be routed to another port, e.g., port 171*b* of the main valve 170 to close the main valve 170 and thereby prevent pressurized air from flowing through the primary flow passage 105 and exit the nozzle 130. Thus, the actuator assembly and the air hoses of the actuation conduit 153 may be configured to enable the actuator assembly 150 to pneumatically actuate and deactivate the pneumatic air excavator 100.

Figure 6A:
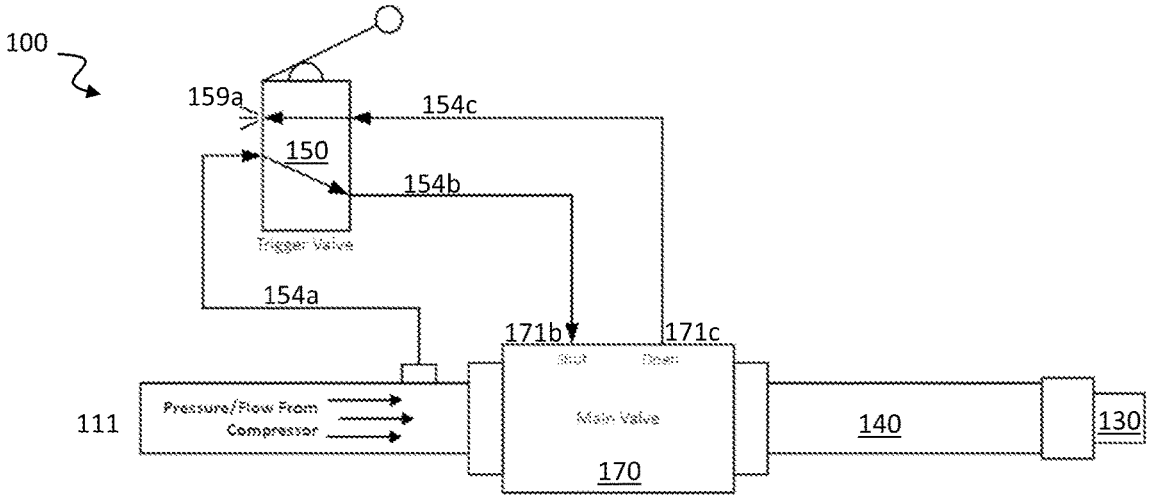
FIGS. 6A and 6B illustrate pneumatic circuit diagrams of the pneumatic excavator, according to implementations of the present disclosure.
Figure 6B:
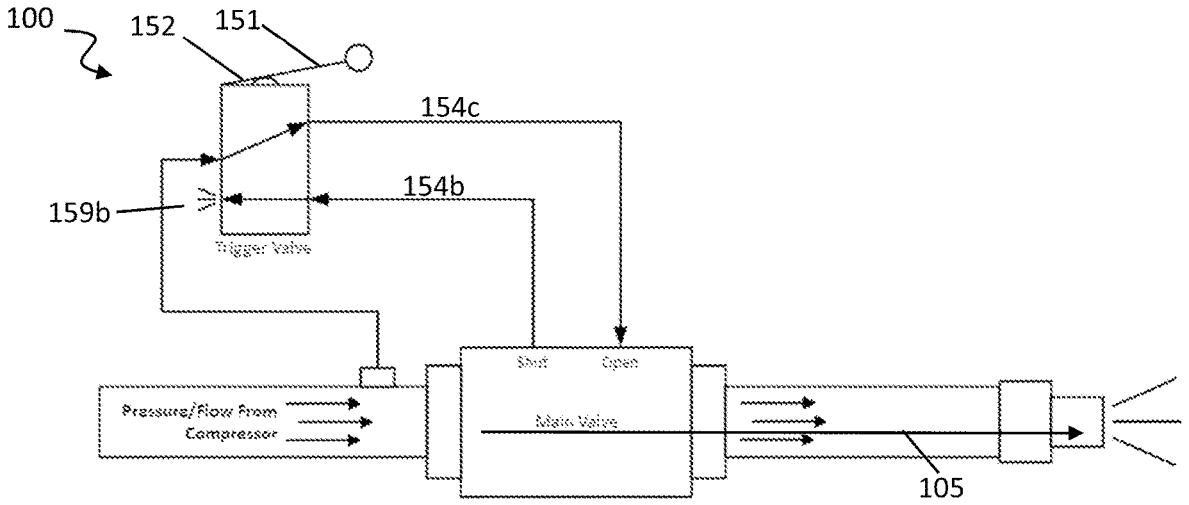

FIGS. 6A and 6B illustrate circuit diagrams of pneumatic actuation of the pneumatic excavator 100, according to implementations of the present disclosure.

With reference to FIG. 6A, in the open position of trigger 151 (e.g., in an unactuated state), pressurized air is routed from the actuator assembly 150 to the air hose 154*b*, which extends to the flow valve 170, e.g., to the primary valve, port 171*b* such that the compressed air maintains and/or forces the flow valve 170 to the closed position as shown in FIG. 6A, e.g., the piston 175 remains seated in the valve seat 176 (FIG. 4A) such that no compressed air flows through the primary flow passage 105 of the pneumatic air excavator 100. Any entrapped air present in the port 171*c* may be vented through the air hose 154*c* to an exhaust port 159*a* of the actuator assembly 150.

With reference to FIG. 6B, when the trigger 151 of the actuator assembly 150 is pressed, the trigger valve 152, e.g., the spool of a spool valve, shifts and the compressed air is no longer delivered to the air hose 154*b*. In this state of the trigger 151 and the trigger valve 152, the constant pressure delivered to the actuator assembly 150 is then directed to the air hose 154*c* to deliver compressed air to the port 171*c* of the flow valve 170 to open the flow valve 170 as shown in FIG. 6B, e.g., the piston 175 is pushed away from the valve seat 176 to thereby move the flow valve 170 to the open position (FIG. 4B) such that compressed air flows through the primary flow passage 105 and exits the nozzle 130. At the time of depressing the trigger 151 pressure keeping the flow valve 170 shut is released or vented from the air hose 154*b*. For instance, any entrapped air present in the port 171*b* may be vented through the air hose 154*b* and to the exhaust port 159*b* of the actuator assembly 150.

As described herein, the air hose 154*a* may be connected upstream of the flow valve 170 and may constantly receive an air signal, e.g., may be constantly pressurized and be a constant pressure conduit of the actuator assembly 150. In the open position of trigger 151 (e.g., in an unactuated state), pressurized air is routed from the actuator assembly 150 to the air hose 154*b*, which extends to the flow valve 170, e.g., to the primary valve, port 171*b* such that the compressed air maintains and/or forces the flow valve 170 to the closed position as shown in FIG. 4A, e.g., the piston 175 remains seated in the valve seat 176 such that no compressed air flows through the primary flow passage 105 of the pneumatic air excavator 100. Accordingly, the constant supply of compressed air may be constantly delivered to one of the ports 171*b* or 171*c* of the flow valve 170. In some implementations, the flow valve 170 is a pneumatic valve requiring the delivery of the compressed air to one of its ports 171*b* and 171*c* in order to open and close, and accordingly the flow valve 170 may be free of a biasing mechanism such as a return spring.

Figure 7:
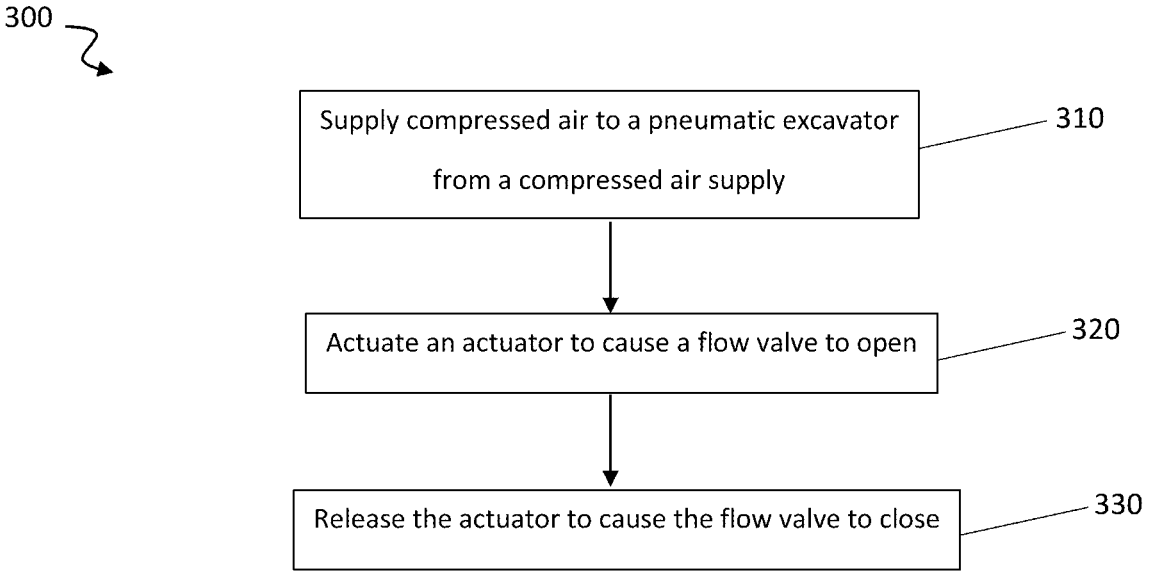
FIG. 7 illustrates a flow diagram of a method of pneumatically actuating the pneumatic air excavator, according to implementations of the present disclosure.

According to implementations of use, as illustrated in FIG. 7, a method 300 of pneumatically actuating the pneumatic excavator 100 may involve supplying compressed air to the pneumatic excavator 100 from a compressed air supply in operation 310, e.g., via the delivery line 111 coupled to an air compressor truck. Initially, the compressed air supply is prevented from passing through the barrel 140 and exiting the nozzle 130 due to the flow valve 170 being in a closed position (FIGS. 4A, 6A), and for instance, the piston 175 of the flow valve 170 may seal against a valve seat 176 of the flow valve 170. As provided herein, the air supply from the delivery line 111 may deliver compressed air to the actuator assembly 150, such as via the flexible air hose 154*a* of the actuation conduit 153 coupled between the flow valve 170 and the actuator assembly 150. More particularly, the air hose 154*a* may be coupled to the flow valve 170 at a port 171*a* positioned upstream of the piston 175 such that the compressed air is permitted to constantly pass through the flexible air hose 154*a* and to the actuator assembly 150 as long as the delivery line 111 is supplied with compressed air. The flexible air hose 154*a* may thus be configured as a constant pressure conduit that is constantly supplied compressed air. In this initial state of the pneumatic excavator 100 with the supply of compressed air, the actuation switch of the actuator assembly 150 is in the open position and the compressed air from the flexible air hose 154*a* is transmitted through the actuator assembly 150 to the air hose 154*b* of the actuation conduit 153, which in turn transmits the compressed air to the port 171*b* of the flow valve 170 to force the piston 175 of the flow valve 170 against the valve seat 176 thereof to pneumatically force the flow valve 170 in a closed position or retain the flow valve 170 in the closed position, e.g., the compressed air is prevented from passing through the flow valve 170 and the primary flow passage 105.

The method 300 may continue by actuating the actuator assembly 150 in operation 320 by moving the actuation switch, e.g., by depressing the trigger 151. When the actuation switch is actuated, e.g., in the closed position, compressed air is transmitted from the actuator assembly 150 through the air hose 154*c* of the actuation conduit 153, to the flow valve 170 to cause the flow valve 170 to move to an open position (FIGS. 4B, 6B) where the compressed air from the compressed air supply passes from the delivery line 111 and through the primary flow passage 105 of the pneumatic excavator 100 and exit the nozzle 130. In the open position of the flow valve 170, the piston 175 is pushed away from the valve seat 176 to permit air to pass through. For instance, the trigger valve 152 may include a spool valve with a spool and spool pilot, and the spool is biased by a biasing mechanism such as a spring or solenoid valve. When the trigger 151 is depressed, the spool may move against the bias force of the biasing mechanism.

The method 300 may proceed by releasing the actuator assembly 150 in operation 330 by moving the actuation switch to an open position, e.g., by releasing the trigger 151. For instance, release or deactivation may cause the trigger 151 to move under the force of the biasing mechanism as it moves to the unbiased state, e.g., to a normal position. More particularly, a spool of the trigger valve 152 may shift to a normal position, which may force the trigger 151 to an open or unactuated position. When the actuation switch is in the open position, the compressed air may be transmitted from the actuator assembly 150 through the actuation conduit 153, e.g., air hose 154*b*, to the flow valve 170 to cause the flow valve 170 to again move to the closed position (FIGS. 4A, 6A), where the flow valve 170 prevents the compressed air from passing therethrough, e.g., by the piston 175 of the flow valve 170 again sealing against a valve seat 176 of the flow valve 170.

In some implementations, the flow valve 170 may be vented via one or more ports 171*b*, 171*c* when the valve is in the open and/or closed position to facilitate reliable operation of the pneumatic air excavator in the on and off positions. For instance, when the flow valve 170 is in the closed position of FIG. 6A, e.g., due to the compressed air from air hose 154*b* entering port 171*b* of the flow valve 170 and forcing the piston 175 against the valve seat 176, any entrapped air present in the port 171*c* may be vented, for instance through the air hose 154*c* and to an exhaust port 159*a* (FIG. 6A) of the actuator assembly 150. Similarly, when the flow valve 170 is in the open position of FIG. 6B, e.g., due to the compressed air from the air hose 154*c* entering port 171*c* of the flow valve and forcing the piston 175 away from the valve seat 176, any entrapped air present in the port 171*b* may be vented, for instance through the air hose 154*b* and to the exhaust port 159*b* of the actuator assembly 150.

Due to the actuator assembly 150 being configured to pneumatically actuate the flow valve 170 via the actuation conduit 153, e.g., being configured as an air actuation conduit, the actuator assembly 150 may be remotely arranged from the flow valve 170 as illustrated in the Figures. However, the actuator assembly 150 and its actuation conduit 153 may also be arranged on or integrated with the flow valve 170 while not departing from the other advantageous features of the pneumatic air excavator 100 of the present disclosure.

Pneumatically actuating the pneumatic air excavator 100 may provide advantages because use of pressurized air as a means to trigger the flow valve 170 provides an efficient use of pressurized air at the actuator assembly 150 where a small air signal may be used, e.g., via the actuator assembly 150 including the actuation conduit 153, results in a short throw length or relay to cause a large pressure change at the flow valve 170 to cause the flow valve 170 to open and close (FIGS. 4A and 4B). A coaxial-style valve as illustrated in these figures, as well as other pneumatic valves such as ball or angled seat, may thus be operated using a small mechanical operator, like the trigger 151, to open the trigger valve 152 of the actuator assembly 150 to cause pressurized air to flow through the actuation conduit 153 to operate the flow valve 170 as provided herein.

Venting may occur during operation of the compressed air excavator 100 to cause opposing pressure to be vented to the atmosphere. For instance, during movement of compressed air through the primary flow passage 105, e.g., while the piston 175 is separated from the valve seat 176, the opposing pressure directed against the piston 175 may be released and discharged or vented through the port 171*b* (FIG. 4B), may proceed through the air hose 154*b* and be exhausted through the exhaust port 159*a* at the actuator assembly 150. Once the trigger 151 is released, the pressure keeping the flow valve 170 open is released from the air hose 154*c*, e.g., the air is vented to atmosphere such as via an exhaust port 159*b* of the actuator assembly 150, and the compressed air is delivered from the actuator assembly 150 back to the air hose 154*b* such that the compressed air forces the piston 175 against the valve seat 176 to seal the flow valve 170 in a closed position. In some implementations, the flow valve 170 may include a mechanical biasing mechanism such as a return spring to facilitate movement of the piston 175 to the closed position.

In some implementations, the actuator assemblies may be biased such as spring loaded. For instance, depressing the trigger 151 against a spring force may cause trigger valve 152 to shift from its initial or normal position and the flow valve 170 to move to an open or on position as provided herein. When the trigger 151 is released, the spring relaxes and may cause the trigger valve 152 to shift back to its initial or normal position, which may cause the flow valve 170 to move to the closed or off position as provided herein. In other implementations, one or more actuators or valves of the pneumatic air excavator 100, e.g., of the actuator assembly and/or the controller, may be biased by a solenoid valve.

Various changes may be made in the form, construction and arrangement of the components of the present disclosure without departing from the disclosed subject matter or without sacrificing all of its material advantages. The form described is merely explanatory, and it is the intention of the following claims to encompass and include such changes. Moreover, while the present disclosure has been described with reference to various embodiments, it will be understood that these embodiments are illustrative and that the scope of the disclosure is not limited to them. Many variations, modifications, additions, and improvements are possible. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A pneumatic excavator configured to be pneumatically actuated, comprising:

an actuator;

a flow valve fluidly coupled to the actuator by at least a first air actuation conduit and a second air actuation conduit, the first air actuation conduit extending between a first port of the actuator and a first port of the flow valve, the second air actuation conduit extending between a second port of the actuator and a second port of the flow valve;

a barrel coupled to an egress of the flow valve, wherein an egress of the barrel defines an outlet of the pneumatic excavator; and a constant pressure conduit, wherein a first end of the constant pressure conduit is coupled to the pneumatic excavator at an upstream position from the egress of the flow valve, and a second end of the constant pressure conduit is coupled to the actuator, wherein a primary flow passage is defined at least by the flow valve and the barrel, wherein actuating the actuator causes compressed air to be transmitted from the actuator through the first air actuation conduit to the first port of the flow valve to cause the flow valve to move to an open position such that the compressed air from a supply of compressed air passes through the primary flow passage and exits through the outlet of the pneumatic excavator, and wherein releasing the actuator causes the compressed air to be transmitted from the actuator through the second air actuation conduit to the second port of the flow valve to cause the flow valve to move to a closed position, wherein in the closed position, the flow valve prevents the compressed air from the supply of compressed air from passing therethrough.

2. The pneumatic excavator of claim 1, wherein the actuator further comprises a valve, wherein when the actuator is actuated, the valve is configured to fluidly couple the constant pressure conduit to the first air actuation conduit, and wherein when the actuator is not actuated or is released, the valve is configured to fluidly couple the constant pressure conduit to the second air actuation conduit.

3. The pneumatic excavator of claim 2, wherein the valve comprises a trigger biased by a biasing mechanism configured to be manually actuated.

4. The pneumatic excavator of claim 1, wherein in the closed position of the flow valve, a piston of the flow valve seals against a valve seat.

5. The pneumatic excavator of claim 1, further comprising at least one vent port configured to vent the compressed air from the flow valve.

6. The pneumatic excavator of claim 5, wherein the at least one vent port is defined in the actuator.

7. The pneumatic excavator of claim 1, wherein the actuator comprises a trigger biased by a biasing mechanism.

8. The pneumatic excavator of claim 7, wherein the biasing mechanism comprises a return spring.

9. A pneumatic excavator configured to be pneumatically actuated, comprising:

an actuator;

a flow valve fluidly coupled to the actuator by at least one air actuation conduit; and a barrel coupled to an egress of the flow valve, wherein an egress of the barrel defines an outlet of the pneumatic excavator, wherein a primary flow passage is defined at least by the flow valve and the barrel, wherein actuating the actuator causes compressed air to be transmitted from the actuator through the at least one air actuation conduit to a first port of the flow valve to cause the flow valve to move to an open position such that the compressed air from a supply of compressed air passes through the primary flow passage and exits through the outlet of the pneumatic excavator, and wherein releasing the actuator causes the compressed air to be transmitted from the actuator through the at least one air actuation conduit to a second port of the flow valve to cause the flow valve to move to a closed position, wherein in the closed position, the flow valve prevents the compressed air from the supply of compressed air from passing therethrough, and wherein the flow valve is free of a biasing mechanism such that the flow valve requires the compressed air to move the flow valve to the open position and to the closed position.

10. The pneumatic excavator of claim 9, further comprising a constant pressure conduit, wherein a first end of the constant pressure conduit is coupled to the pneumatic excavator at an upstream position from the egress of the flow valve, and a second end of the constant pressure conduit is coupled to the actuator.

11. The pneumatic excavator of claim 10, wherein when the actuator is actuated, the constant pressure conduit is configured to be fluidly coupled to a first air actuation conduit of the at least one air actuation conduit, and wherein when the actuator is not actuated or is released, the constant pressure conduit is configured to be fluidly coupled to a second air actuation conduit of the at least one air actuation conduit.

12. The pneumatic excavator of claim 9, further comprising a trigger biased by a biasing mechanism.

13. The pneumatic excavator of claim 12, wherein the biasing mechanism comprises a return spring.

14. The pneumatic excavator of claim 12, wherein the trigger is configured to be manually actuated.

15. The pneumatic excavator of claim 9, further comprising at least one vent port configured to vent the compressed air from the flow valve.

16. A method of pneumatically actuating a pneumatic excavator, comprising:

supplying compressed air to a pneumatic excavator from a compressed air supply, the pneumatic excavator comprising an elongated barrel, an actuator and a flow valve, the elongated barrel having an ingress and an egress, the ingress configured to be fluidly connected to the compressed air supply, the egress defining an outlet of the pneumatic excavator, the actuator comprising at least a first air actuation conduit and a second air actuation conduit configured to be fluidly connected to the compressed air supply, the flow valve fluidly coupled to the actuator via the first and second air actuation conduit, wherein a primary flow passage is defined at least by the flow valve and the barrel;

actuating the actuator to cause the compressed air to be transmitted from the actuator through the first air actuation conduit to the flow valve to cause the flow valve to move to an open position, wherein in the open position of the flow valve, the compressed air from the compressed air supply passes through the primary flow passage and exits through the outlet of the pneumatic excavator; and releasing the actuator to cause the compressed air to be transmitted from the actuator through the second air actuation conduit to the flow valve to cause the flow valve to move to a closed position, wherein in the closed position, the flow valve prevents the compressed air from passing therethrough, wherein the pneumatic excavator further comprises a constant pressure conduit, and wherein the compressed air is constantly delivered to the constant pressure conduit and to the actuator during the supplying of compressed air.

17. The method of claim 16, wherein the actuator further comprises a valve, wherein when the actuator is actuated, the valve is configured to cause the compressed air to be transmitted through the constant pressure conduit to the first air actuation conduit, and wherein when the actuator is not actuated or is released, the valve is configured to cause the compressed air to be transmitted through the constant pressure conduit to the second air actuation conduit.

18. The method of claim 16, further comprising venting the compressed air from the flow valve when the flow valve is in at least one of the open position or the closed position.

19. The method of claim 16, wherein the actuator is biased by a biasing mechanism such that the releasing of the actuator causes the actuator to move to an unbiased position.

20. The method of claim 16, wherein the flow valve is free of a biasing mechanism such that the flow valve requires the compressed air to move the flow valve to the open position and to the closed position.

* * * * *